US005105873A

United States Patent [19]

Warmington et al.

[11] Patent Number: 5,105,873

[45] Date of Patent: Apr. 21, 1992

[54] CASTING OPERATION EMERGENCY SHUT-OFF APPARATUS

[76] Inventors: C. Edward Warmington, 9756 Winner Rd., Independence, Mo. 64052; Dennis L. Warmington, 24900 E. Bunchue Rd., Independence, Mo. 64050

[21] Appl. No.: 756,293

[22] Filed: Sep. 6, 1991

[51] Int. Cl.[5] ..... B22D 11/10; B22D 41/16

[52] U.S. Cl. ..... 164/152; 164/437; 222/601

[58] Field of Search ..... 164/437, 337, 152, 153; 222/601

[56] References Cited

U.S. PATENT DOCUMENTS

| | | | |
|---|---|---|---|
| 2,834,075 | 5/1958 | Hansen | 164/152 |
| 2,921,351 | 1/1960 | Momm | 164/337 X |
| 3,421,667 | 1/1969 | Stiteler | 222/601 |
| 3,786,962 | 1/1974 | VanLinder | 164/337 X |
| 3,802,683 | 4/1974 | Lee et al. | 222/601 |
| 4,271,896 | 6/1981 | Becus | 164/337 X |
| 4,298,147 | 11/1981 | Honda et al. | 164/437 X |
| 4,461,336 | 7/1984 | Remeika | 164/437 X |
| 4,589,635 | 5/1986 | Reichard et al. | 222/601 X |
| 4,643,404 | 2/1987 | Riegler et al. | 222/601 X |

FOREIGN PATENT DOCUMENTS

| | | | |
|---|---|---|---|
| 0010082 | 4/1980 | European Pat. Off. | 222/601 |

*Primary Examiner*—J. Reed Batten, Jr.

*Attorney, Agent, or Firm*—Hovey Williams Timmons & Collins

[57] ABSTRACT

The apparatus for manually interrupting the flow of molten metal from the tundish includes a frame, and elements for removably securing the frame to the tundish adjacent the tundish orifice. The apparatus further includes a plug assembly for blocking the flow of the molten metal through the orifice. Linkage assembly is provided for moving the plug assembly between a flow permitting and a flow blocking position. The plug assembly is supported on the linkage assembly so that the plug assembly may seek a sealing seat in the orifice.

13 Claims, 6 Drawing Sheets

CASTING OPERATION EMERGENCY SHUT-OFF APPARATUS

BACKGROUND OF THE INVENTION

1. Field of the Invention

The present invention relates generally to continuous casting of molten metal, and more particularly to an apparatus for manual interruption of molten metal flow from a metering orifice.

2. Discussion of the Prior Art

The continuous casting of metals frequently involves four distinct steps. First, metal stock, often at ambient temperature, is placed in a furnace, wherein sufficient heat is applied to reduce the metal stock to a liquid state in which the metal may be poured. Second, a suitable means of conveyance, in most cases a ladle or bucket adapted for the purpose and attached to an appropriate structure for free movement about the work space, is lowered into or adjacent the furnace where it is filled with molten metal by dipping or pouring. Third, the ladle or bucket is conveyed to a tundish, where the molten metal is poured into the tundish. Finally, the tundish ordinarily includes one or more metering nozzles or orifices on its underside, and these are positioned above one or more molds so that the molten metal may pass freely from the nozzle into the mold.

In normal operation, this procedure is not particularly hazardous. However, in the event of a power failure, a potentially dangerous situation may be presented. In such a circumstance, it is quite likely that the mold will cease drawing material, so that as the molten metal continues to flow through the nozzles, the mold will fill to capacity in a short period of time. When the mold is thus filled, and molten metal continues to flow from the tundish, such excess molten metal will flow onto the floor of the work space, presenting a danger to workers and equipment.

In view of this potentially dangerous situation, it has long been recognized that a method for interrupting the flow of molten metal during an emergency is necessary. In the past, at least three common methods for interrupting molten metal flow have been used. The most primitive of these methods has been the use of an L-shaped steel bar, with a chill plug of appropriate dimension attached to the end of the short leg. In this method, an operator simply uses the long leg of the steel bar as a handle, and inserts the chill plug into the orifice. The operator must then hold the steel bar in this position until the metal in the orifice solidifies, normally a period of between 20 and 30 seconds.

A second method or system for addressing the problem has been to provide what is known as a "slide-gate" mechanism. The "slide-gate" mechanism is a valve system of which the nozzle is a part. As the name implies, in this system a sliding plate valve incorporated with the nozzle is used to seal the tundish orifice in the event of an emergency. Closure of the "slide-gate" generally takes 4–5 seconds. Finally, the interruption system set forth in Remeika U.S. Pat. No. 4,461,336 provides an apparatus that is normally automated and which incorporates a piston driven linkage system for inserting a chill plug into a tundish nozzle.

The existing methods for interrupting the flow of molten metal during an emergency have various shortcomings. Obviously, the manual system of using an L-shaped steel bar to insert a chill plug presents a very dangerous situation to the operator. In this manual system, the operator must stay in close proximity to the tundish and hold the L-shaped steel bar in place, usually for from 20 to 30 seconds, until sufficient hardening occurs to block flow from the orifice. While he is doing this, molten metal may continue to flow from adjacent orifices, splashing onto the work place floor, as well as on the operator himself. However, since the operator cannot leave the first nozzle until it is sealed, the dangerous flow of molten metal from other nozzles simply must continue until he is free to move, or until other operators become available.

While the "slide-gate" method is somewhat more safe from the point of view of the operator, this system is also more expensive since the sliding valve is incorporated with the nozzle, and the entire nozzle slide-gate is rendered unusable once it has been used in an emergency situation. The nozzle-slide gate costs approximately $250.00 per individual nozzle, and each must be replaced after use. In addition, the entire assembly is priced in the region of $10,000.00 per unit.

Finally, the more sophisticated system disclosed in U.S. Pat. No. 4,461,336 can present several difficulties. When the system disclosed in the patent is operated in the automated mode, it reduces the control that the operator must have during an emergency situation. For example, the patent does not disclose that the linkage arm controlling the chill plug may be adjusted for optimum engagement of the plug with the orifice. This is of critical importance because in most continuous casting applications, the tundish nozzle is replaced after each use. When such nozzles are replaced, there is quite often considerable "play" in the newly fitted nozzle, so that a flow interrupter plug that is not adjustable will not always properly seat within the nozzle. This problem is addressed in the present invention, which provides a flow interrupter plug that is adjustable.

Further, in many applications a protective shroud, often called a "Pollard shroud", is used to control potential splashing of molten metal as it exits the nozzles. This is a tin shroud placed around the stream of liquid steel, into which is fed gaseous nitrogen to prevent oxidation. This protective shroud is not conducive to the use of the patented device, which requires more space than is available when the shroud is used. In addition, the Remeika device is permanently mounted on the tundish. This not only affects the relationship of the flow interrupter plug to the nozzle, as noted above, but also reduces the flexibility of the entire system.

SUMMARY OF THE INVENTION

It is an object of the present invention to provide an apparatus for manually interrupting the flow of molten metal from a tundish which allows the operator of the apparatus to properly position a chill plug relative to the tundish orifice or nozzle prior to an emergency situation in which the apparatus must be used, so that the nozzle may be properly moved into it and seated in the event of such an emergency.

Another object of the present invention is to provide an apparatus, including a frame, for manually interrupting the flow of molten metal from a tundish, and means for removably securing the frame to the tundish adjacent the tundish orifice.

It is yet another object of the present invention to provide an apparatus for manually interrupting the flow of molten metal from a tundish, including linkage assembly for moving a flow blocking means between a flow permitting and flow blocking position.

It is a further object of the present invention to provide means for supporting the flow blocking means on the linkage assembly so that the flow blocking means may seek a sealing seat in the tundish orifice.

In accordance with the present invention, a continuous casting apparatus comprises a tundish for receiving and temporarily containing molten metal. The tundish has an orifice adapted to discharge molten metal from the tundish. A mold is positioned remote from the tundish to receive, contain and form molten metal from the orifice. The system includes an apparatus for manually interrupting the flow of molten metal from the tundish in an emergency. The flow interrupting apparatus has a frame, and means for removably securing the frame to a tundish adjacent the tundish orifice. The apparatus further includes means for blocking the flow of molten metal through the orifice, and linkage assembly for moving the flow blocking means between a flow permitting and a flow blocking position. The apparatus has means for supporting the flow blocking means on the linkage assembly to enable the flow blocking means to seek a sealing seat in the orifice. According to the invention, the frame is thus affixed to the underside of a tundish, proximate one or more tundish nozzles. The apparatus is removable, and may be situated in a different posture to accommodate prevailing space considerations. The apparatus frame cooperates with an L-shaped bracket structure permanently attached to the tundish, and is secured to this structure by means of manually adjustable knobs. When the apparatus is secured to the tundish, the flow blocking means or chill plug is manually adjusted by the operator to snugly fit the individual nozzle. The assembly is then placed in the ready position, and can instantly be made operable by simple movement of the linkage arm.

BRIEF DESCRIPTION OF THE DRAWINGS

A preferred embodiment of the invention is described in detail below with reference to the attached drawing figures, wherein.

DETAILED DESCRIPTION OF THE PREFERRED EMBODIMENT

Figure 6:
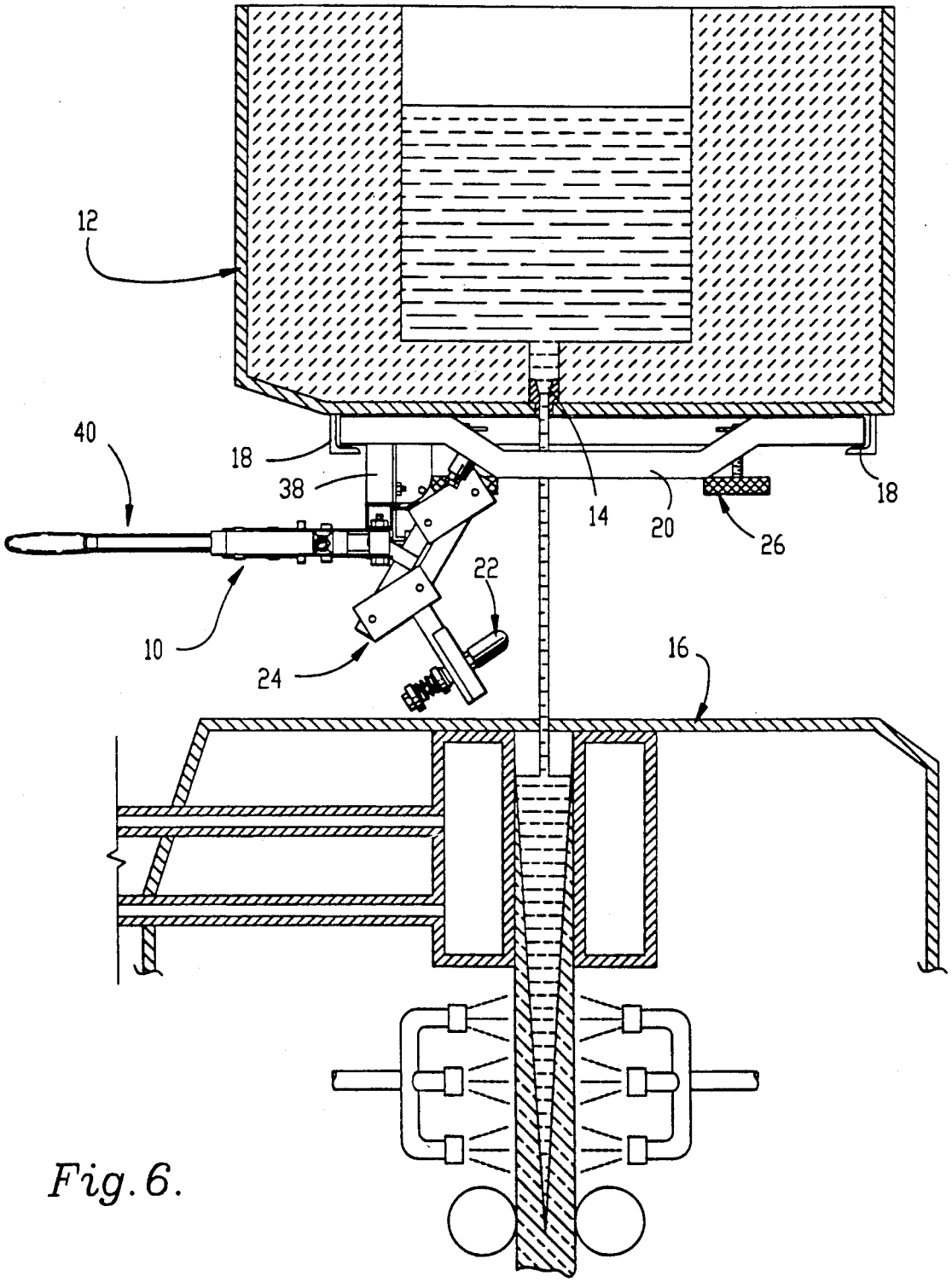
FIG. 6 is a sectional view of a continuous casting system including a side elevational view of the apparatus of the present invention.

Turning first to FIG. 6, a continuous casting operation is illustrated, including a manually-operated emergency shut-off apparatus 10 constructed in accordance with a preferred embodiment of the present invention. The casting operation employs a tundish 12 adapted to receive molten metal from a ladle or the like and to direct the molten metal through a nozzle 14 into a mold 16.

On the lower surface of the tundish a pair of spaced, L-shaped brackets 18 are welded or otherwise affixed in order to define a pair of support flanges by which the shut-off apparatus is suspended. The shut-off apparatus 10 broadly includes a frame 20, a flow-blocking plug assembly 22, and a linkage assembly 24 supporting the plug assembly on the frame for movement between a retracted position, as shown in FIG. 6, wherein the plug assembly is withdrawn from the flow path of molten metal passing from the tundish into the mold, to an extended position, as shown in FIG. 1, wherein the plug assembly is forced into the orifice of the nozzle so as to block the flow of molten metal through the nozzle.

Figure 1:
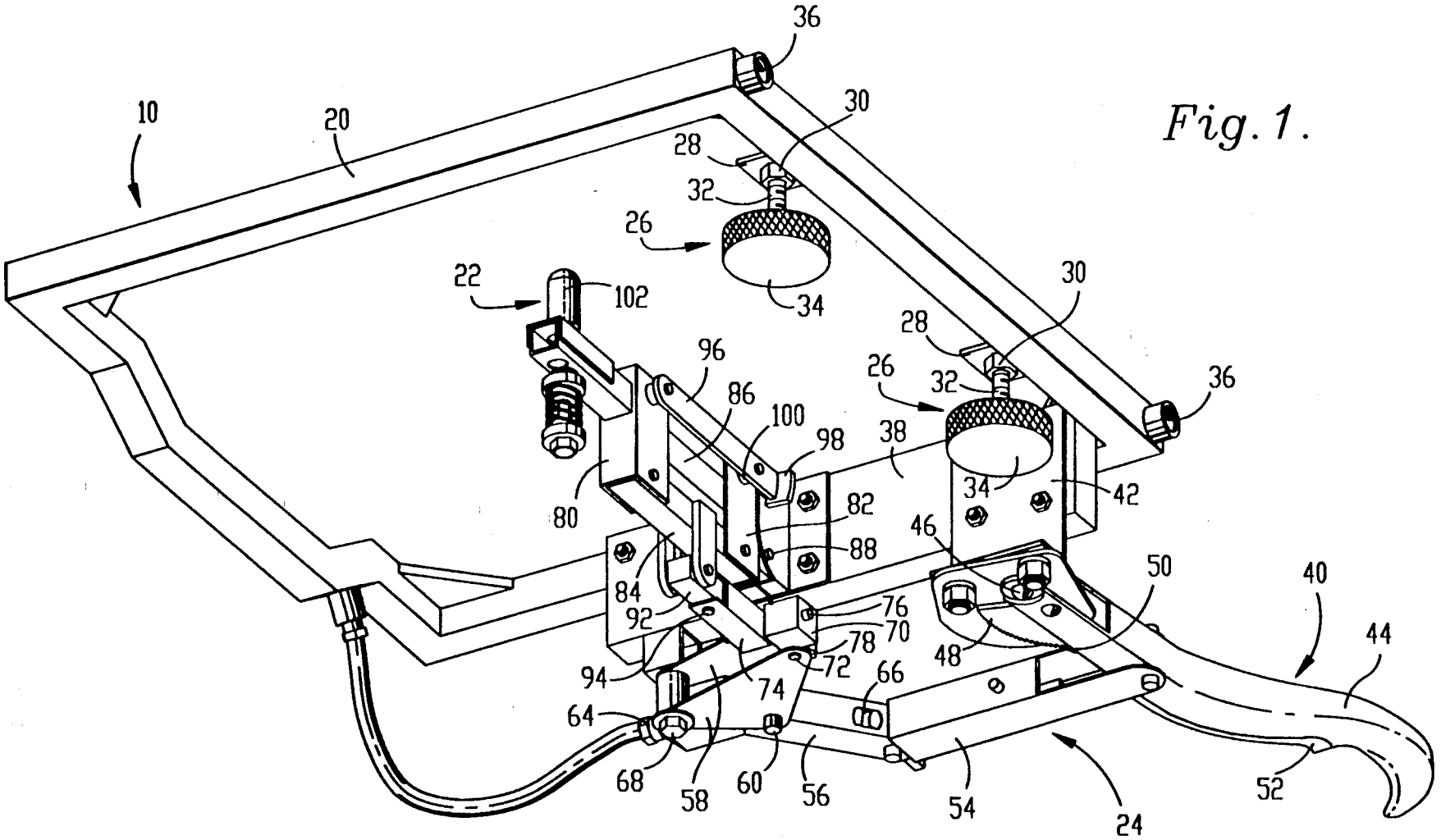
FIG. 1 is a bottom perspective view of an apparatus for manual interruption of molten metal flow from a metering orifice, constructed in accordance with the preferred embodiment.

As shown in FIG. 1, the frame 20 is rectangular and is formed of four lengths of hollow steel tubing to permit the passage of a cooling medium, such as gaseous nitrogen or argon, through the frame for cooling the frame and the elements of the linkage assembly 24. Steel is more desirable than, for example, aluminum, since the bottom of the tundish generally radiates heat at a temperature of about 800° F., and steel is more resistant to such extreme temperatures.

In addition to allowing for the passage of a cooling medium, the hollow structure of the frame 20 reduces the overall weight of the apparatus in order to permit the apparatus 10 to be moved about manually.

Attached to the frame 20 is a plurality of locking mechanisms 26, located generally at the corners of the frame 20. Each of the locking mechanisms 26 includes a metal tab 28 welded to the frame 20, a threaded nut 30 welded to the tab 28, and a threaded rod 32 having a hand knob 34. The threaded rods 32 cooperate with the lower surface of the tundish to hold the frame in position relative to the tundish and permit removal of the apparatus in order to permit repair and/or replacement of all or part of the apparatus.

At least one of the lengths of the frame 20 is provided with a notch or recessed area which allows the apparatus 10 to be easily fitted onto the tundish even when the nozzle 14 extends beyond the lower surface of the tundish 12. At least one cooling gas inlet 36 is provided on the frame for permitting attachment of a source of cooling gas to the hollow inner volume of the frame 20. The gas is normally operated at pressure, so as to maintain circulation of cooling gas through the frame in and around the linkage assembly 24.

The linkage assembly 24 is supported on the frame 20 by a hollow supporting member 38 fastened to one of the lengths. The supporting member 38 is preferably hollow and the interior volume thereof is in communication with the inner volume of the frame tubing so that cooling gases pass into the supporting member to cool the linkage assembly.

Figure 5:
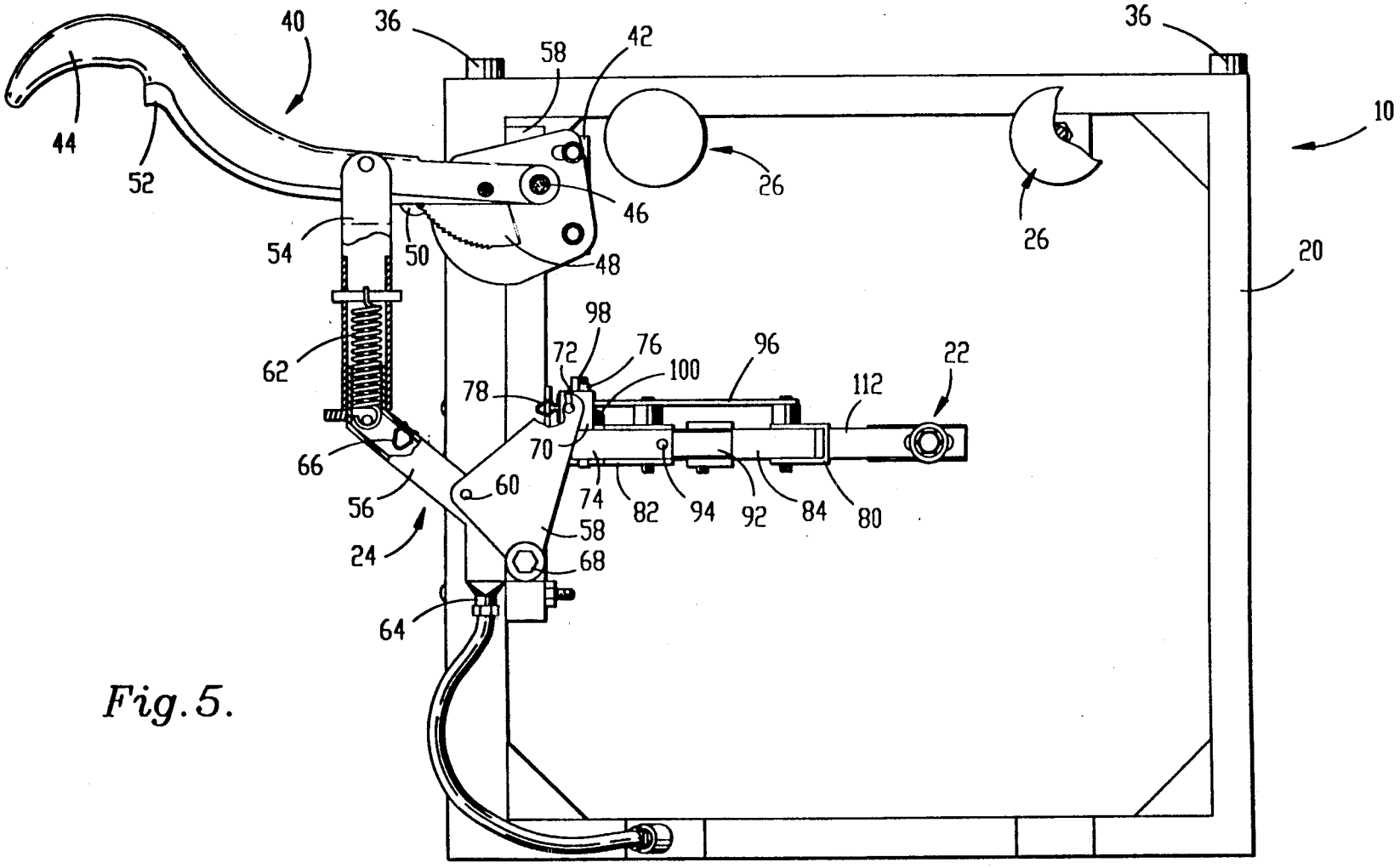
FIG. 5 is a top plan view of the apparatus of the present invention, illustrating the flow blocking means in the operative position, with a portion of the first force transmitting member cut away to disclose a locking spring.

A handle mechanism 40 forms one part of the linkage assembly 24 and is secured to the supporting member 38 by a mounting bracket 42. A handle 44 is mounted on the bracket 42 for pivotal movement about an axis defined by the pin 46, and a ratchet 48 is supported on the bracket for movement relative to the handle during movement of the handle. As shown in FIG. 5, the handle 44 is provided with a pawl 50 which is spring biased into engagement with the teeth of the rachet to retain the handle in an actuated position such as that shown in FIG. 5. Disengagement of the pawl 50 from the rachet 48 is carried out by a spring biased lever 52 which pulls the pawl away from the rachet when depressed. In this manner, an operator, by depressing the lever, is able to return the handle to a nonactuated position.

A first force-transmitting link 54 is connected to the handle 44 for pivotal movement relative thereto and includes a hollow length and an open distal end adapted to receive the end of an adjacent second force-transmitting member 56. The second force-transmitting member is also hollow and is supported on a pair of spaced triangular plates 58 by a pivot pin 60 for pivotal movement relative to the pair of plates. A tension spring 62 extends between a pin provided on the first member 54 and a pin provided on the second member 56, and urges the end of the second member into the distal end of the first member and holds the two members in engagement with one another. A gas inlet 64 is provided on the second member 56 and suitable tubing is provided for connecting this inlet with the hollow inner volume of the frame 20 in order to permit cooling gases to be delivered to the spring.

A hole may be provided in the second member 56 which supports a detent receiving member 66. The triangular plates 58 are secured to the supporting member 38 by a pivot pin 68 which permits the plates to pivot together relative to the supporting member. The pivot pin 68 is located at one corner of the plates 58 and the pivot pin 60 supporting the second member is located at a second of the corners such that movement of the second member 56 causes the triangular plates to pivot about the pin 68.

A block 70 is supported between the triangular plates 58 at a third corner thereof by a pin 72 which permits rotation of the block relative to the triangular plates. This block 70 transmits the movement of the triangular plates to an intermediate link 74 supported on the block by a pin 76. The pin 76 connecting the intermediate link to the block extends in a direction perpendicular to the direction in which the pivot pin 72 of the block extends so that the intermediate link 74 is free to pivot within a plane perpendicular to the planes defined by the triangular plates 58. A male detent member 78 is secured to the block 70 and adapted for receipt in the receiving member 66 provided on the second force-transmitting link 56 in order to retain the handle mechanism 40 in a nonactuated position such as that illustrated in FIG. 4.

The plug assembly 22 is supported on a first U-shaped bracket 80 which is spaced from a second U-shape bracket 82 by a pair of parallel, spaced links 84, 86 extending between the brackets. The second bracket 82 is supported on the supporting member 38 by a pivot pin 88 which permits the second bracket to pivot relative to the supporting member.

Figure 2:
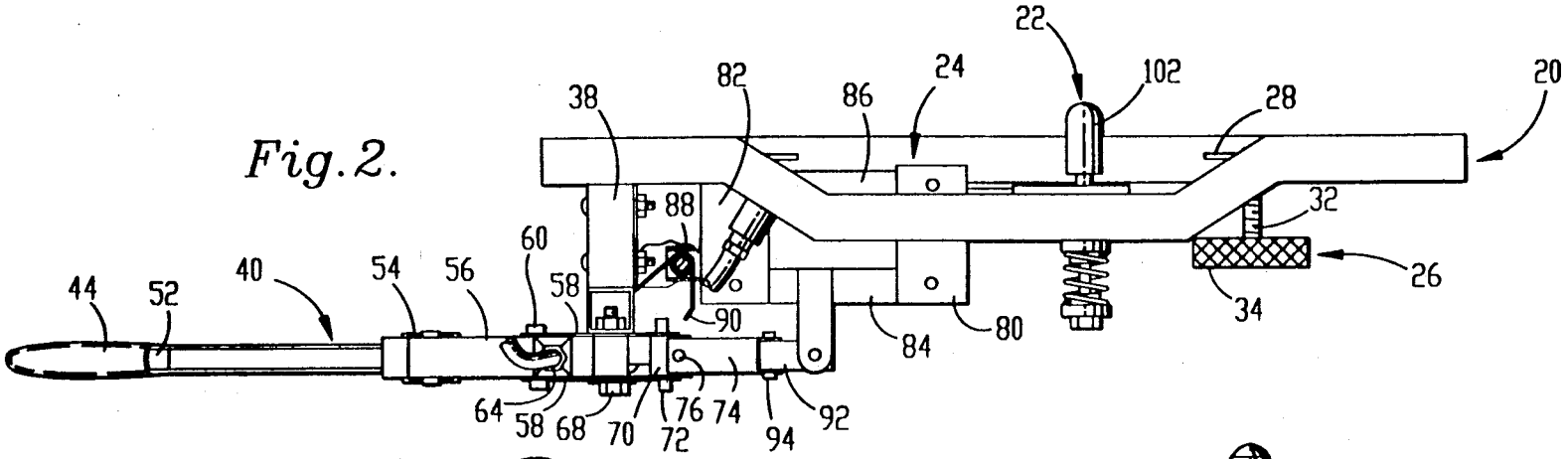
FIG. 2 is a side elevation of the apparatus of the present invention, illustrating the flow blocking means in the operative position, with a portion cut away to show a biasing spring in relation to the linkage assembly.

As shown in FIG. 2, a spring 90 is provided about the pivot pin 88 and includes a first end resting against the supporting member and a second end pressing against the second U-shaped bracket so that the bracket is constantly urged toward a position in which the bracket rests against the supporting member, as shown in FIG. 2.

Movement of the handle is transmitted to the lower link 84 by the intermediate link 74 which is connected to the lower link by a transmitting element 92 supported on the link for pivotal movement, as shown in FIG. 1. The transmitting element 92 is connected to the intermediate link 74 by a pivot pin 94 extending in a direction perpendicular to the pin 76 in order to accommodate the arcuate paths of movement of the various links within the linkage assembly.

Figure 3:
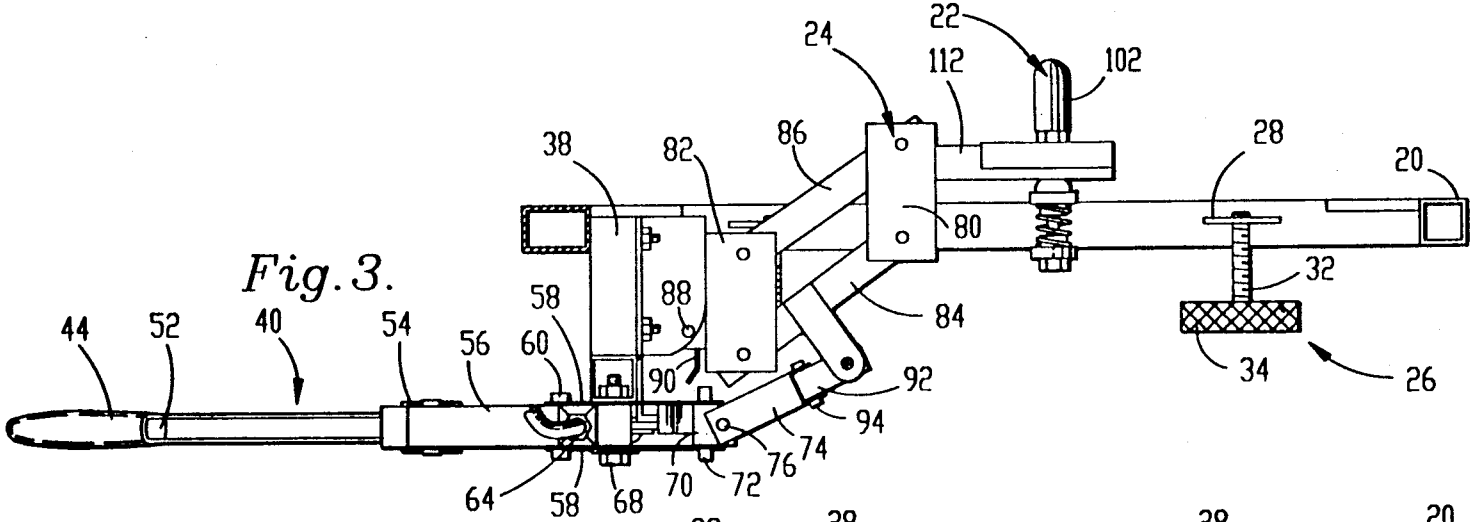
FIG. 3 is a side elevation of the apparatus of the present invention, illustrating the flow blocking means in the operative position, and illustrating the hollow tube frame in cross section.

A restraining bar 96 is supported by each of the U-shaped brackets 80, 82 and extends in a direction parallel to the links 84, 86. The restraining bar includes an arcuate flange 98 at an end thereof adjacent the second bracket 82 so that when the second bracket is moved toward the actuated position, as shown in FIG. 3, the arcuate flange engages a pin 100, shown in FIG. 5, provided on the supporting member 38 and prevents the second bracket from being forced away from the supporting member against the bias of the spring 90.

Figure 7:
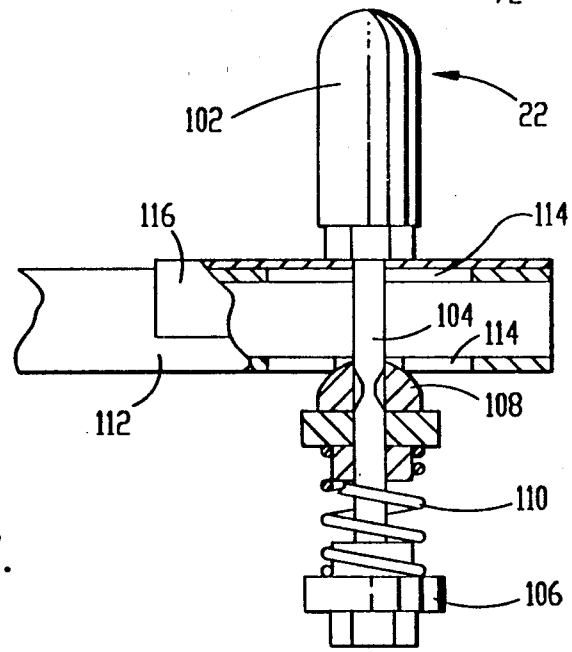
FIG. 7 is a sectional view of the apparatus of the present invention, illustrating a detailed view of the flow blocking means.

The plug assembly 22 is shown in FIG. 7, and includes a plug 102 permanently affixed to a pin 104 having a distal end provided with a circumferential flange 106. A detent 108 is provided on the pin between the plug and the flange and is urged toward the plug by a compression spring 110. The first U-shaped bracket 80 includes an arm 112 having a pair of opposed slots in which the pin 104 is received. Preferably, the slot 114 adjacent the detent is shaped like three interconnected circles in order to define three seating positions for the detent 108 relative to the arm. The pin 104 is movable in the axial direction of the arm within the slots, and the detent 108 moves from one of the seating positions to the next during such axial movement to retain the plug on the arm after the desired movement has been carried out. A cover 116 is supported on the pin 104 and is movable therewith. The cover serves to prevent molten material or debris from getting into the slots and interfering with the relative movement between the pin and the arm.

Figure 8:
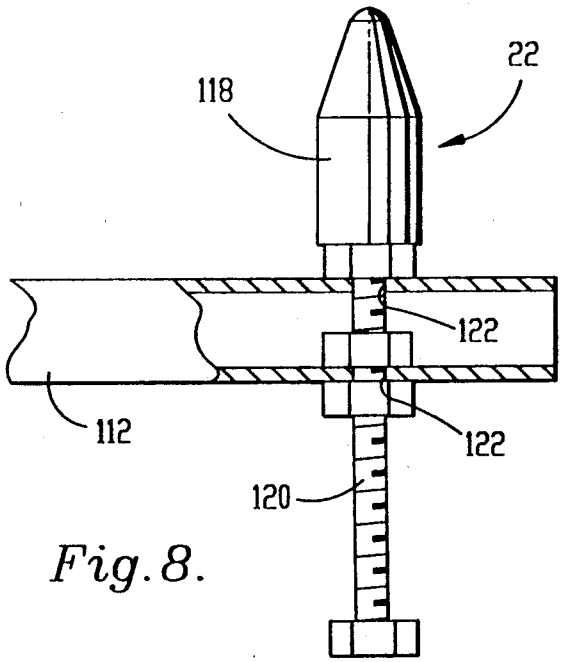
FIG. 8 is a sectional view of the apparatus of the present invention, illustrating an alternate embodiment of the flow blocking means.

An alternate construction of the plug assembly 22 is illustrated in FIG. 8, and includes a plug 118 supported on a pin 120. The arm 112 includes a pair of opposed holes 122 through which the pin extends, and suitable means are provided for securing the pin on the arm. Preferably, the plug 118 includes a tapered point which helps guide the plug into the orifice of the nozzle 14 during movement of the apparatus to the actuated position.

Turning to FIG. 6, in order to install the apparatus on the tundish 12, it is necessary to first affix the L-shaped brackets 18 to the lower surface of the tundish such that the flanges defined by the brackets face one another and are spaced a suitable distance apart to permit the insertion of the frame 20 of the apparatus 10.

Thereafter, the frame may be slid into position between the brackets 18. The length of the frame provided with the recess is inserted first in order to permit the frame 20 to clear the nozzle 14 should it be extending beyond the lower surface of the tundish 12. In order to properly position the plug 102 of the plug assembly 22 relative to the nozzle 14, the handle 44 is moved to the actuated position, as shown in FIG. 1, and the frame 20 is readjusted relative to the brackets 18 so that the plug 102 is positioned within the nozzle orifice. Thereafter, the threaded rods 32 of the locking mechanisms 26 are turned into engagement with the lower surface of the tundish to secure the frame against further movement relative to the tundish.

Figure 4:
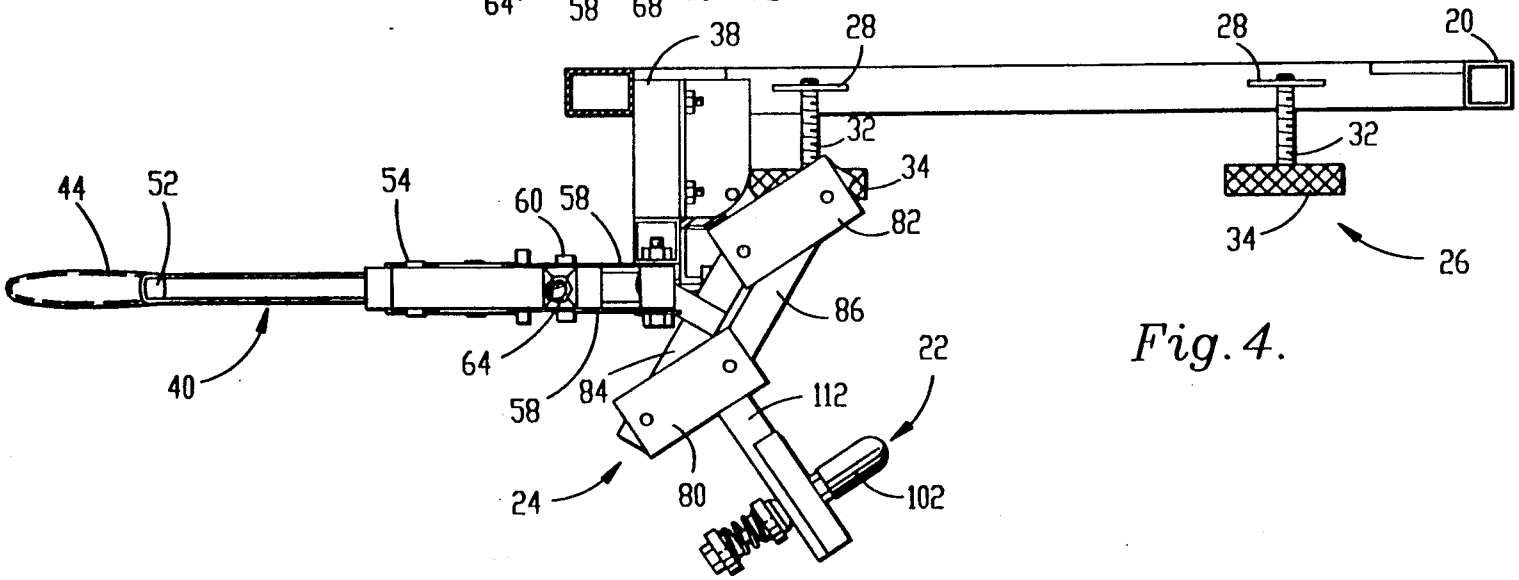
FIG. 4 is a side elevation of the apparatus of the present invention, illustrating the flow blocking means in the retracted position.

During a continuous casting operation, the shut-off apparatus 10 is normally maintained in a nonactuated position, as shown in FIGS. 4 and 6, with the plug assembly 22 withdrawn from the nozzle 14 and retracted away from the flow path of molten metal pouring from the nozzle into the mold 16. When the handle mechanism is in the nonactuated position, the detent members 66, 78, shown in FIG. 5, are in engagement with one another and hold the handle mechanism in the nonactuated position.

It is conventional to provide a shroud around the flow of molten metal to protect the flow from exposure to oxygen. Preferably, the apparatus is constructed to provide room for the shroud when in the nonactuated position. However, if the shut-off apparatus is actuated, the shroud must typically be removed in order to permit the plug to be moved into the nozzle orifice.

When an emergency situation arises, such as a power outage, which requires shut-off of the flow of molten metal from the tundish 12, the handle 44 is moved manually toward the actuated position shown in FIG. 3, overcoming the retention force of the detent members 66, 78. During the initial movement of the handle, the spring biases the second bracket toward the position shown in FIG. 2. Further movement of the handle 44 causes the parallel links 84, 86 to move the first bracket 80 along an arcuate path toward the nozzle so that the plug assembly 22 is disposed within the flow path of the molten metal. As the parallel links 84, 86 move along this arcuate path, the flange 98 of the restraining member 96 engages the pin 100 on the supporting member 38 to prevent the second bracket 82 from pivoting about the pivot pin 88. In this manner, the second bracket is locked to the supporting member 38 in order to prevent the flow of molten metal from forcing the plug assembly out of the flow path.

Once the plug assembly 22 has been moved to the actuated position, as shown in FIG. 1, with the plug 102 positioned within the orifice of the nozzle 14, continued movement of the handle 44 causes the first force-transmitting link 54 to pull away from the second force-transmitting link 56 against the biasing force of the spring 62. The loaded spring exerts a force on the entire linkage assembly 24 which is transmitted to the plug 102 and biases the plug into the nozzle so as to hold the plug in place until the metal within the nozzle hardens and seals off further flow. The cooperation between the pawl 50 and ratchet 48 prevents the handle 44 from moving back toward the nonactuated position until the lever 52 is depressed.

After the emergency situation has been rectified, the lever 52 is depressed, releasing the pawl 50 from the ratchet 48, and the linkage assembly 24 is returned to the nonactuated position. If it is found that the plug 102 is stuck within the nozzle, suitable steps may be taken to first loosen the plug from either the linkage assembly or the nozzle before operating the linkage assembly.

Figure 9:
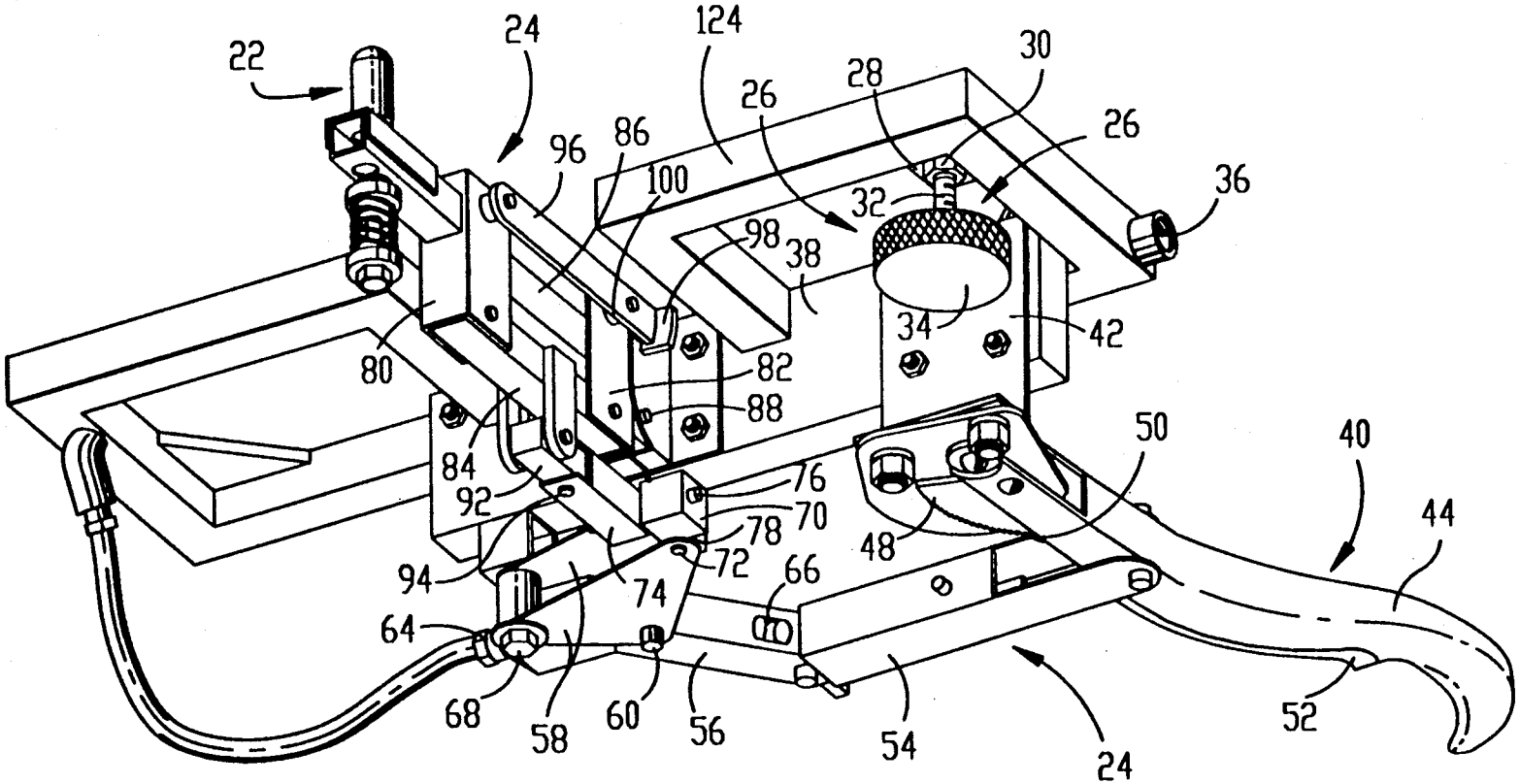
FIG. 9 is a bottom perspective view of the apparatus of the present invention, illustrating an alternate embodiment with a modified frame.

FIG. 9 illustrates an alternate embodiment of the invention. In the illustrated example, the frame 124 has simply been reduced in size to accommodate the use of the invention with tundishes of different configuration. This abbreviation of the frame size does not alter the operation of the invention in any respect. All of the significant elements appurtenant to the frame 124, such as the cooling gas inlet 36, the locking mechanisms 26 and the linkage assembly 24 remain associated with this embodiment.

The advantages of the present invention may readily be seen. In contrast to the ancient form of stopping molten metal flow with an L-shaped bar, the present invention allows the operator to make one arm movement and them remove himself from proximity of the tundish. In contrast to the sliding gate mechanism previously discussed, the present invention permits reuse of the plug assembly. Finally, as distinguished from automated systems, the present invention allows for adjustment of the plug assembly to deal with subtle variations in the placement of the tundish valve. In addition, the present invention allows for attachment to a tundish from at least two different directions, and allows the operator to have control over the emergency interruption of molten metal in a fashion not permitted by automated systems. The present invention may thus be adapted so that each tundish nozzle may be sealed independently of the other, as conditions may warrant. Thus, the operator can decide when to activate the invention, and the quick sealing provided by the invention allows the operator to move on to further nozzles, as needed. When conditions allow, the present invention allows the plug to be retrieved and reused.

Although the invention has been described with reference to the illustrated preferred embodiment, it is noted that equivalents may be employed and substitutions made herein without departing from the scope of the invention as recited in the claims.

We claim:

1. In a continuous casting apparatus comprising a tundish for receiving and temporarily containing molten metal, an orifice adapted to discharge said molten metal from said tundish, and a mold remote from said tundish and positioned to receive, contain and form said molten metal from said orifice, an apparatus for manually interrupting the flow of molten metal from the tundish, said apparatus comprising:

a frame;

means for removably securing said frame to said tundish adjacent said orifice;

means for blocking the flow of said molten metal through said orifice;

linkage assembly for moving said flow blocking means between a flow permitting and a flow blocking position; and means for supporting said flow blocking means on said linkage assembly so that said flow blocking means may seek a sealing seat in said orifice.

2. The apparatus as set forth in claim 1 wherein said frame comprises hollow tubing adapted to permit circulation of cooling medium.

3. The apparatus as set forth in claim 1 wherein said frame is adapted to permit passage of said frame over said orifice during securement of said frame to said tundish.

4. The apparatus as set forth in claim 2 wherein said tubing is releasably connected to a source of cooling medium.

5. The apparatus as set forth in claim 1 wherein said frame includes means for mounting said linkage assembly to said frame.

6. The apparatus as set forth in claim 6 wherein said linkage mounting means includes means for communicating with the interior of said frame for receiving cooling medium therefrom.

7. The apparatus as set forth in claim 1 wherein said flow blocking means includes adjustment means for moving said flow blocking means into a sealing seat in said orifice.

8. In a continuous casting apparatus comprising a tundish for receiving and temporarily containing molten metal, an orifice adapted to discharge said molten metal from said tundish, and a mold remote from said tundish and positioned to receive, contain and form said molten metal from said orifice, an apparatus for manually interrupting the flow of molten metal from the tundish, said apparatus comprising:

a frame;

means for removably securing said frame to said tundish adjacent said orifice;

means for blocking the flow of said molten metal through said orifice;

linkage assembly for moving said flow blocking means between a flow permitting and a flow blocking position; and hand operated means for operating said linkage assembly to move said flow blocking means between said flow permitting position and said flow blocking position.

9. The apparatus as set forth in claim 8 wherein said frame comprises hollow tubing adapted to permit circulation of cooling medium.

10. The apparatus as set forth in claim 9 wherein said frame is adapted to permit passage of said frame over said orifice during securement of said frame to said tundish.

11. The apparatus as set forth in claim 9 wherein said tubing is releasably connected to a source of cooling medium.

12. The apparatus as set forth in claim 9 wherein said frame includes means for mounting said linkage assembly to said frame.

13. The apparatus as set forth in claim 12 wherein said linkage mounting means includes means for communicating with the interior of said frame for receiving cooling medium therefrom.

* * * * *